US008746230B2

(12) United States Patent
Trautner et al.

(10) Patent No.: US 8,746,230 B2
(45) Date of Patent: Jun. 10, 2014

(54) METHOD FOR AERATING AND DEAERATING AN OVEN, AND AN OVEN

(75) Inventors: Andreas Trautner, Neuendettelsau (DE); Markus Schmid, Abtsgmund (DE); Franz Schmidt, Paderbon (DE)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 13/634,010

(22) PCT Filed: Mar. 30, 2011

(86) PCT No.: PCT/EP2011/001584
§ 371 (c)(1),
(2), (4) Date: Dec. 26, 2012

(87) PCT Pub. No.: WO2011/120675
PCT Pub. Date: Oct. 6, 2011

(65) Prior Publication Data

US 2013/0186386 A1 Jul. 25, 2013

(30) Foreign Application Priority Data

Apr. 1, 2010 (EP) ..... 10003650

(51) Int. Cl.
*F24C 15/00* (2006.01)

(52) U.S. Cl.
USPC ..... 126/198; 126/21 A; 126/193

(58) Field of Classification Search
USPC ..... 126/198, 193, 21 A, 273 R; 219/394
See application file for complete search history.

(56) References Cited

U.S. PATENT DOCUMENTS

| | | | | |
|---|---|---|---|---|
| 8,006,687 | B2 * | 8/2011 | Watkins et al. | 126/198 |
| 2010/0065035 | A1 | 3/2010 | Armstrong et al. | |
| 2010/0065036 | A1 | 3/2010 | Watkins et al. | |

FOREIGN PATENT DOCUMENTS

| | | |
|---|---|---|
| EP | 1586821 | 10/2005 |
| FR | 2853720 | 10/2004 |
| GB | 2026685 | 2/1980 |

OTHER PUBLICATIONS

International Search Report for PCT/EP2011/001584, dated May 11, 2011, 3 pages.

*Primary Examiner* — Alfred Basichas
(74) *Attorney, Agent, or Firm* — Pearne & Gordon LLP

(57) ABSTRACT

The present invention relates to a method for aerating and deaerating an oven (1), which has at least two oven muffles (2, 3) disposed one above the other, the feed apertures (5, 6) of which are or can be closed in each case by a door (7, 8), comprising the following procedural steps: cooling air (L) is drawn off from an outside area surrounding the oven (1), and the drawn-off air (L) is blown at least partially into interior spaces (9, 10) of the doors (7, 8) and then blown out into the outside area after flowing through at least a part of the interior spaces (9, 10), wherein the drawn-off air (L) is blown into the upper door (7) in an upper section of that door (7) and flows substantially downward from above through the interior space (9) of the door (7), wherein the drawn-off air (L) is blown into the interior space (10) of the lower door (8) at a bottom end section thereof and flows substantially upward through the interior space (10) of the door (8), and that the air blown into the interior spaces (9, 10) of the two doors (7, 8) is blown out to the outside area after flowing through the interior spaces (9, 10) of the doors (7, 8) in the lower section of the upper door (7) and the upper section of the lower door (8).

8 Claims, 3 Drawing Sheets

METHOD FOR AERATING AND DEAERATING AN OVEN, AND AN OVEN

TECHNICAL FIELD

Figure 1:
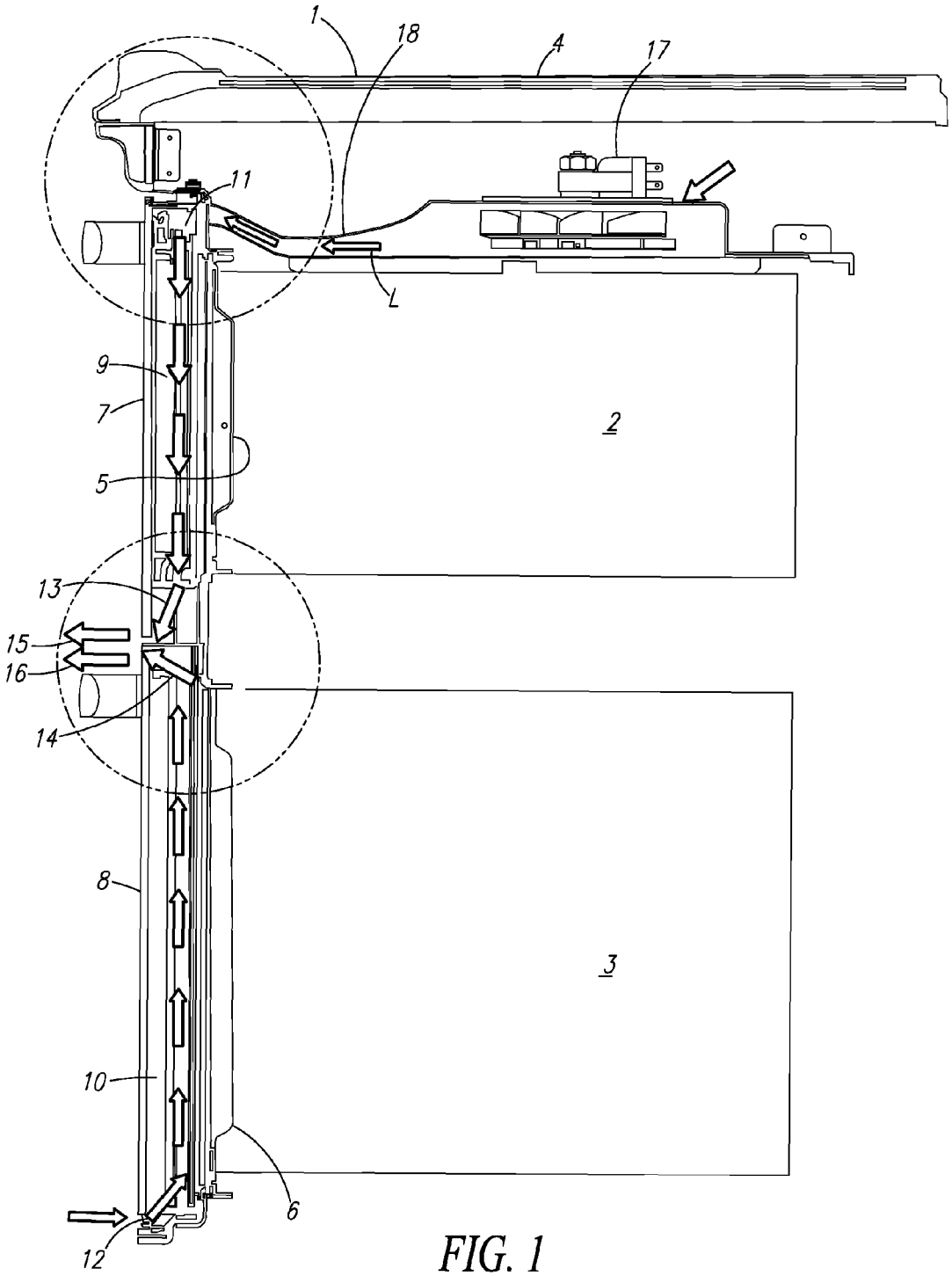

The present invention relates to a method for aerating and deaerating an oven, which has at least two oven muffles disposed one above the other, the feed apertures of which are or can be closed in each case by a door, wherein cooling air is drawn off from an outside area surrounding the oven, and the drawn-off air is blown at least partially into interior spaces of the doors and then blown out into the outside area after flowing through at least a part of the interior spaces, and wherein the drawn-off air is blown into the upper door in an upper section of that door and flows substantially downward from above through the interior space of the door. Moreover, the invention relates to an oven, which has at least two oven muffles disposed to one above the other, the feed apertures of which are or can be closed in each case by a door, for carrying out this method.

A method and oven of this kind are known from EP 2 031 309 A2. The previous oven disclosed in this document comprises two oven muffles disposed one above the other and each having a feed aperture, which can be closed by a door. The oven further comprises an air conveyance device, which is arranged above the upper oven muffle near the housing rear wall of the oven. The conveyance device draws off air from an outside area of the oven to blow at least part thereof into interior spaces defined in the two doors. Specifically the interior spaces of the doors are connected in series, and the drawn-off air is blown through an inlet aperture at the upper end of the upper door into the interior space thereof and is then conveyed through the interior spaces of both doors downwardly in succession, to leave the oven through an outlet aperture provided at the bottom end region of the lower door.

The problem involved with this arrangement consists in that the conveyance path of the air through the interior spaces of both doors is comparatively long, which may lead to poor cooling results in the lower end region of the bottom door, in particular as the air has been heated up along its way through the interior spaces.

Accordingly, it is an object of the invention to provide a method for aerating and deaerating an oven of the above mentioned kind as well as an oven for carrying out this method, which enable a comparatively even cooling effect on the two doors.

According to the present invention this object is solved in a method of the initially mentioned kind in that the drawn-off air is blown into the interior space of the lower door at a bottom end section thereof and flows substantially upward through the interior space of the door, and that the air blown into the interior spaces of the two doors is blown out into the outside area after flowing through the interior spaces of the doors in the lower section of the upper door and the upper section of the lower door. Moreover, this object is solved in an oven of the above mentioned kind in that the inlet opening of the lower door is provided in a bottom end section of that door and the outlet aperture is provided in the upper end section of that door, so that air entering the interior space of the lower door flows substantially upward through the interior space of the door, and that the air leaving the interior spaces of the upper door and the lower door are blown outwards into the outside area.

The invention is based on the idea, that the doors of oven muffles can be cooled evenly if the cooling air flows through the doors in a counter current manner, namely substantially downward from above through the interior space of the upper door and substantially upward from beneath through the interior space of the lower door. The air can then be blown out to the outside area in the middle section of the oven between the two doors, where it does not trouble any person using the oven. In this case the interior spaces of the two doors have blow-out openings associated thereto for blowing out the air exiting the interior spaces to the front side of the oven.

According to a preferred embodiment of the invention the cooling air is drawn into and through the interior space of the lower door solely by the venturi effect of the air blown out of the interior space of the upper door. For this purpose the blow-out openings associated to the upper oven door and the lower oven door are arranged close to the each other, so that cooling air is drawn into and through the interior space of the lower door by the venturi effect of the air blown out of the interior space of the upper door. In this embodiment no separate conveyance or blowing device is necessitated to convey a cooling air through the interior space of the lower door. Instead the cooling air is automatically sucked into and transported through the interior space by the venturi effect of the air exiting the interior space of the upper door.

Preferably, the door cover of the lower door is formed as a curved guiding element to guide the air leaving interior space of the upper door and/or the air leaving the interior space of the lower door to the blow out opening. In this embodiment the door cover of the lower door is used as a guiding element to obtain good flowing characteristics in the exit section of the doors, where the flow direction of the air has to be changed from substantially vertical to horizontal.

In a similar way, the door cover of the upper door may be provided in its upper section with a curved guiding element for guiding the air entering the door into the interior space.

According to a further embodiment of the invention the cooling air drawn in from the outside area prior to being introduced into the interior space of the upper door is conveyed along at least a part of the outside area of the upper oven muffle or of an air conveyance element contiguous with the outside area of the oven muffle. In this case, the exterior space around the oven muffle will be directly cooled by the cooling air drawn in from the outside area of the oven.

In a manner known per se the interior spaces of doors can be defined in different ways. Specifically the doors usually have an outer pane facing the outer area and an inner pane facing the oven muffle in the closed state of the door. Then an interspace, which is confined by the outer pane and the inner pane and/or an interspace, which is confined by the inner pane or the outer pane on the one hand and an intermediate pane of the door arranged between the outer pane and the inner pane on the other hand and/or an interspace, which is confined between two intermediate panes arranged between the inner pane in the outer pane is defined as the interior space of the door through which the air is conveyed.

Further advantages and features of the present invention may be obtained from the subclaims as well as the following description of an exemplary embodiment of the present invention making reference to the accompanied drawing. In the drawing, FIG. 1 schematically shows a sectional side view of the aerating and diaerating section of an oven according to the present invention, FIG. 2 the area A from FIG. 1 in enlarged scale and FIG. 3 the area B from FIG. 1 in enlarged scale.

FIG. 1 schematically shows an oven 1 according to the present invention. The oven 1 comprises two oven muffles 2, 3, which are disposed one above the other in an oven housing 4, of which only the top wall is depicted. The oven muffles 2, 3 have feed aperture 5, 6 at their front side closed by doors 7, 8, which basically extend in a vertical direction.

The doors 7, 8 each define an interior space 9, 10 with an inlet aperture 11, 12 and an outlet aperture 13, 14, through which air for cooling purposes can be conveyed in a vertical direction (arrows L1 and L2). In case of the upper door 7 the inlet aperture 11 is provided in an upper section and the outlet aperture 13 in a bottom section of that door 7, and in case of the lower door 8 the inlet aperture 12 is provided in a bottom section and the outlet aperture 14 is provided in the upper end section of that door 8. The outlet apertures 13, 14 of the two doors 7, 8 have blow out openings 15, 16 associated thereto for blowing out air exiting the interior spaces 9, 10 to the front side of the oven 1.

Figure 2:
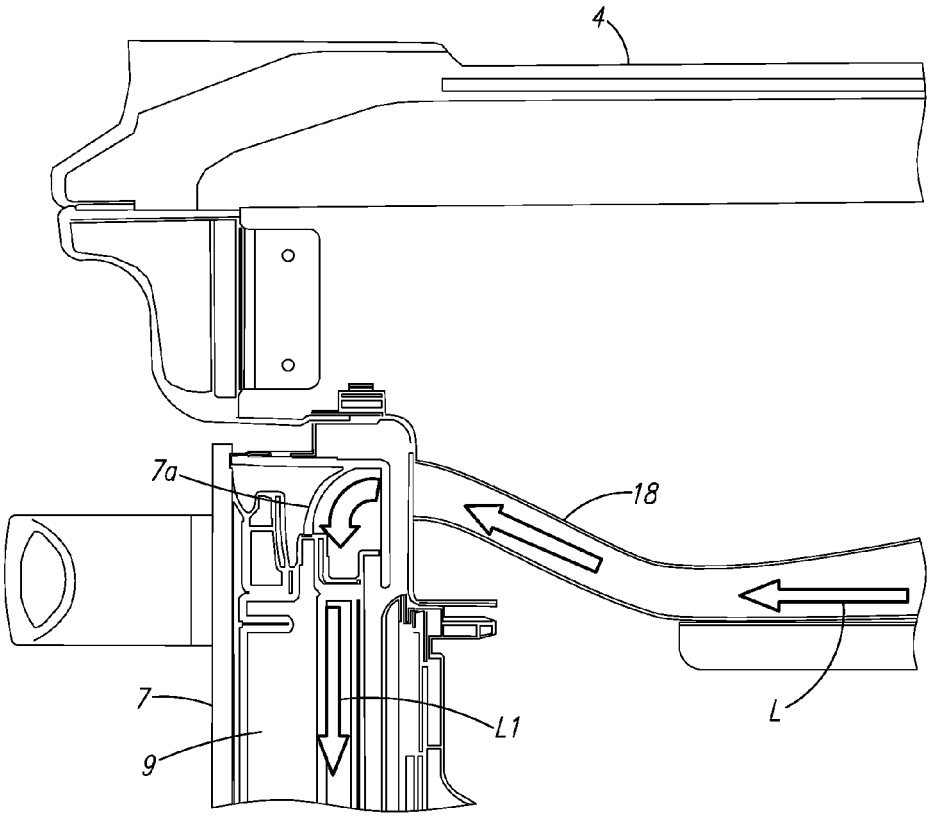
Figure 3:
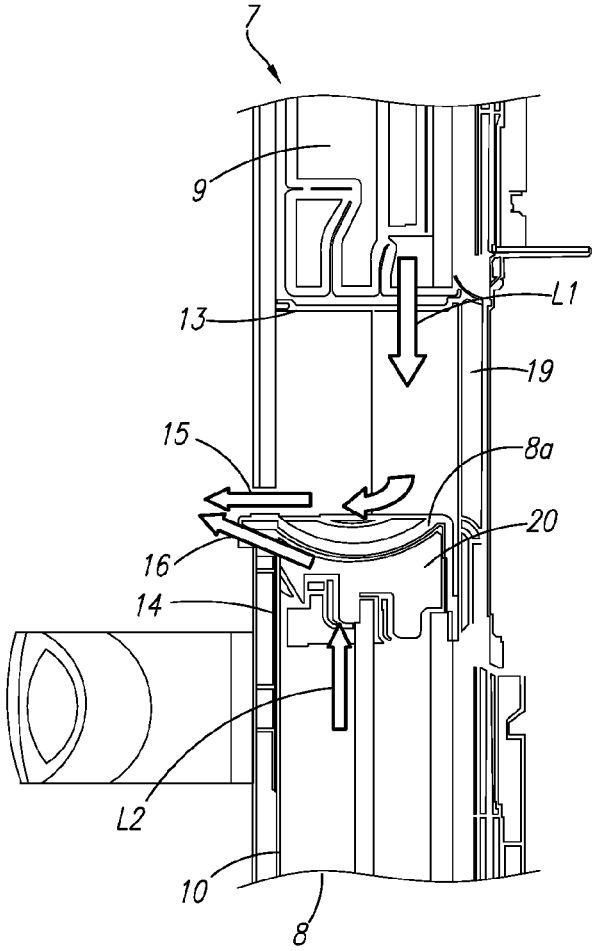

FIGS. 2 and 3 clearly reveal, that the oven further comprises a conveyance device 17 for drawing off cooling air from the outside area of the oven 1 and blowing at least part of the drawn-off air into the interior space 9 of the upper door 7 through the inlet aperture 11 thereof. The conveyance device 17 is a blower or fan, which is provided above the upper oven muffle 2 near the housing rear wall of the oven 1. The outlet of the conveyance device 17 is connected to the inlet aperture 11 of the upper oven door 7 by an air feed channel 18 in order to blow cooling air, which has been drawn off from the outside area of the oven 1 into the interior space 9 of the upper oven door 7, wherein it flows substantially downward (arrows L1) from above through the interior space 9 of the door 7 to exit the same through the outlet aperture 11 and the corresponding blow out opening 15.

The lower oven door 8 has no separate conveyance device associated thereto. Instead—as may be readily obtained from FIGS. 2 and 3—the blow out openings 15, 16 associated to the upper oven door 7 and the one hand the lower oven door 8 on the other hand are arranged so close to each other, that cooling air is drawn into and through the interior space 10 of the lower door (arrow L2) 8 solely by the venturi effect caused by the air blown out of the blow-out opening 15 of the upper door 7.

To obtain good flowing characteristics in the exit sections 19, 20 of the doors 7, 8, where the flow direction of the air has to be changed from substantially vertical to horizontal, the door cover 8*a*, i.e. the top wall of the lower door 8 is formed as a curved guiding element for guiding the air leaving the interior space of the upper door 7 and the lower door 8 towards the blow out openings 15, 16.

In a similar way the upper door 7 is provided in its upper section with a curved guiding element 7*a* for a smoothly redirecting the air entering through the inlet aperture 11 from an almost horizontal entry direction to the vertically downward direction, in which the air is conveyed through the door 7.

The invention claimed is:

1. Method for aerating and deaerating an oven (1), which has at least two oven muffles (2, 3) disposed one above the other, feed apertures (5, 6) of which are or can be closed respectively by an upper door (7) and a lower door (8), comprising the following procedural steps:

a) cooling air (L) is drawn off from an outside area surrounding the oven (1), and b) the drawn-off cooling air (L) is blown at least partially into respective interior spaces (9, 10) of the upper and lower doors (7, 8) and then blown out into the outside area after flowing through at least a part of the interior spaces (9, 10), wherein the drawn-off cooling air (L) is blown into an upper section of the upper door (7) and flows substantially downward from above through the interior space (9) of the upper door (7), further wherein the drawn-off cooling air (L) is blown into the interior space (10) of the lower door (8) at a bottom end section thereof and flows substantially upward through the interior space (1) of the lower door (8), and the air blown into the interior spaces (9, 10) of the upper and lower doors (7, 8) is blown out to the outside area after flowing through the interior spaces (9, 10) of the upper and lower doors (7, 8) in a lower section of the upper door (7) and an upper section of the lower door (8) wherein the cooling air (L) is drawn into and through the interior space (10) of the lower door (8) solely by a venturi effect of the air blown out of the interior space (9) of the upper door (7).

2. Method according to claim 1, wherein the cooling air blown into the interior space (9) of the upper door (7) is blown by a blowing or conveyance device (17).

3. Method according to claim 1, wherein the cooling air (L) drawn in from the outside area prior to being introduced into the interior space (9) of the upper door (7) is conveyed along at least a part of an outside area of the upper oven muffle (2) or of an air conveyance element contiguous with the outside area of the oven muffle (2).

4. Method according to claim 1, wherein the upper and lower doors (7, 8) each have an outer pane facing the outer area and an inner pane facing the oven muffle (2, 3) in a closed state of the upper and lower doors (7, 8) and wherein an interspace, which is confined by the outer pane and the inner pane and/or an interspace, which is confined by the inner pane or the outer pane on the one hand and an intermediate pane of the door (7, 8) arranged between the outer pane and the inner pane on the other hand and/or an interspace, which is confined between two intermediate panes arranged between the inner pane in the outer pane is used as the interior space of the door (7, 8) through which the air is conveyed.

5. An oven comprising:

at least two oven muffles (2, 3) disposed one above the other, feed apertures (5, 6) of which are or can be closed respectively by an upper door (7) and a lower door (8), wherein the upper door (7) and the lower door (8) each define an interior space (9, 10) with at least one inlet aperture (11, 12) and at least one outlet aperture (13, 14), the at least one inlet aperture (11) of the upper door (7) being provided in an upper section of that upper door (7) and the at least one outlet aperture (13) of the upper door (7) being provided in a bottom section of that upper door (7), at least one blowing or conveyance device (17) for drawing off air (2) from an outside area of the oven and blowing at least part of the drawn-off air (2) into at least the interior space (9) of the upper door (7) through the at least one inlet aperture (11) thereof, so that the air flows substantially downward through the interior space (9) of the upper door (7) and escapes therefrom through the outlet aperture (13) thereof, wherein the inlet aperture (12) of the lower door (8) is provided in a bottom end section of that lower door (8) and the outlet aperture (14) is provided in the upper end section of that lower door (8), so that air entering the interior space (10) of the lower door (8) flows substantially upward through the interior space (10) of the lower door (8), and that the air leaving the interior spaces (9, 10) of the upper door (7) and the lower door (8) is blown outwards to the outside area, and blow out openings (15, 16) respectively associated with the upper door (7) and the lower door (8) configured for blowing out the air leaving the interior spaces (9, 10)

wherein the blow out openings are arranged sufficiently close to each other so that the air entering the interior space (10) of the lower door (8) is drawn into and through the interior space (10) of the lower door (8) solely by a venturi effect of the air blown out of the interior space (9) of the upper door (7).

6. Oven according to claim 5 , wherein a door cover (8*a*) of the lower door (8) is formed as a curved guiding element to guide the air leaving the interior space (9) of the upper door (7) and/or the air leaving the interior space (10) of the lower door (8) to the blow out openings (15, 16).

7. Oven according to claim 5, wherein a door cover of the upper door (7) is provided in its upper section with a curved guiding element (7*a*) for guiding air into the interior space (9) of the door (7).

8. Oven according to claim 5 , wherein the doors (7, 8) each have an outer pane facing the outer area and an inner pane facing the oven muffle (2, 3) in the closed state of the door (7, 8) and wherein an interspace, which is confined by the outer pane and the inner pane and/or an interspace, which is confined by the inner pane or the outer pane on the one hand and an intermediate pane of the door (7, 8) arranged between the outer pane and the inner pane on the other hand and/or an interspace, which is confined between two intermediate panes arranged between the inner pane in the outer pane is defined as the interior space of the door (7, 8).

* * * * *